United States Patent [19]

Trottochau

[11] 4,250,812

[45] Feb. 17, 1981

[54] UNDERTRACK FABRIC APPLICATOR

[75] Inventor: Lawrence D. Trottochau, Loretto, Minn.

[73] Assignee: Loram Maintenance of Way, Hamel, Minn.

[21] Appl. No.: 83,826

[22] Filed: Oct. 11, 1979

[51] Int. Cl.[3] ..... E01B 1/00; E01B 37/00

[52] U.S. Cl. ..... 104/2; 238/1; 171/16; 37/104

[58] Field of Search ..... 104/2, 4, 5, 6; 37/104–107; 171/16

[56] References Cited

U.S. PATENT DOCUMENTS

| | | | |
|---|---|---|---|
| 3,382,815 | 5/1968 | Higuchi et al. | 238/1 |
| 3,685,456 | 8/1972 | Plasser et al. | 104/2 |
| 3,699,894 | 10/1972 | Plasser et al. | 104/2 |
| 4,004,524 | 1/1977 | Scheuchzer et al. | 104/2 |

*Primary Examiner*—Richard A. Bertsch

*Attorney, Agent, or Firm*—Warren A. Sturm

[57] ABSTRACT

A pair of spaced apart arms disposed on the side of a railway maintenance machine, the arms extending outwardly and carrying vertically positioned sleeves at their outer ends. Bars are slidably held in the sleeves for mounting of a fabric roll on their upper ends. Extension members extend horizontally from the lower ends of the bars. Idler and tension rollers are rotatably mounted across the arms, and an applicator tube extends diagonally under the machine frame, and beneath track raised by the machine, such that fabric can be continuously unrolled and passed under the tension roller, over the idler roller, over the applicator tube and on the track bed.

15 Claims, 8 Drawing Figures

FIG. 7
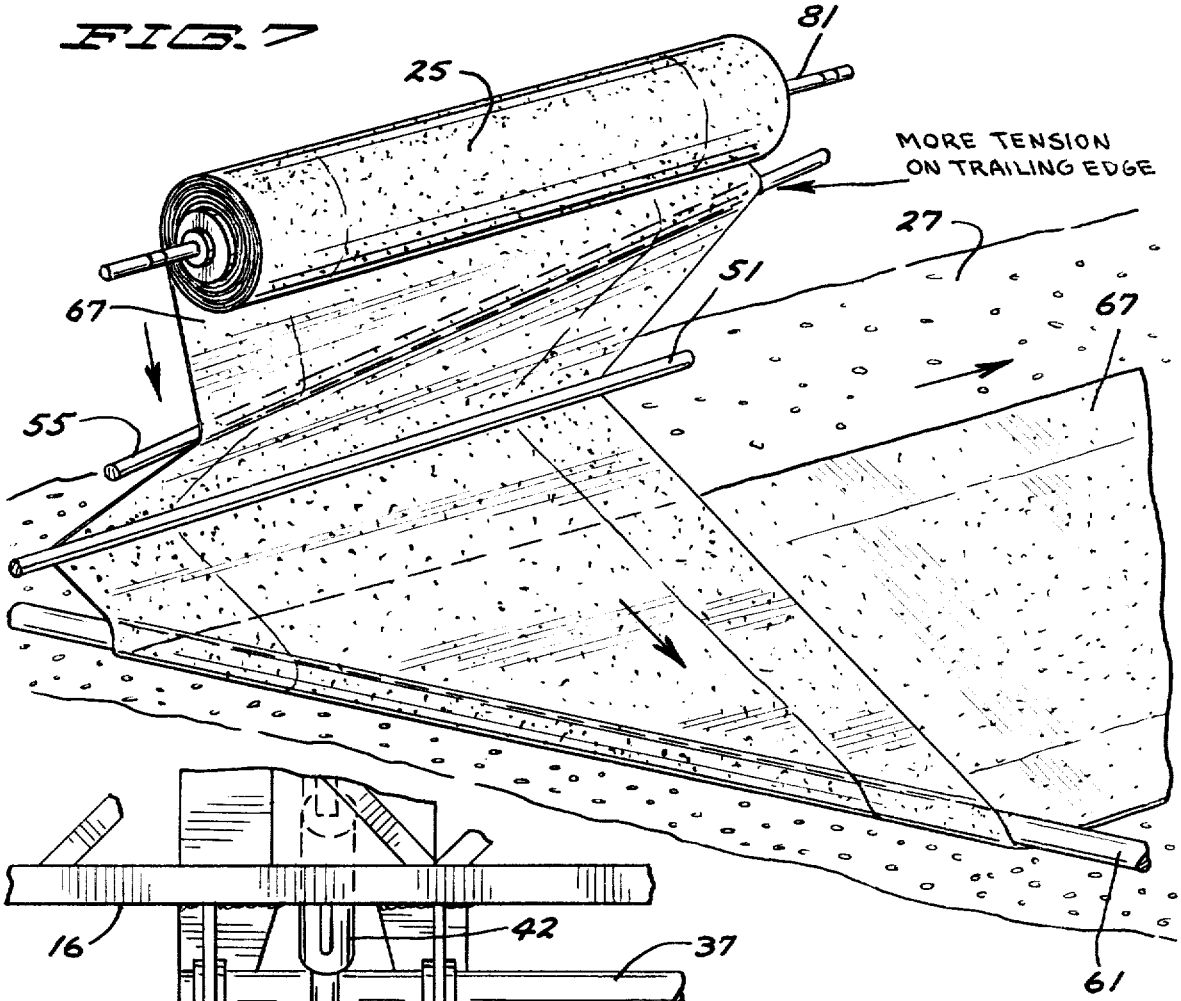
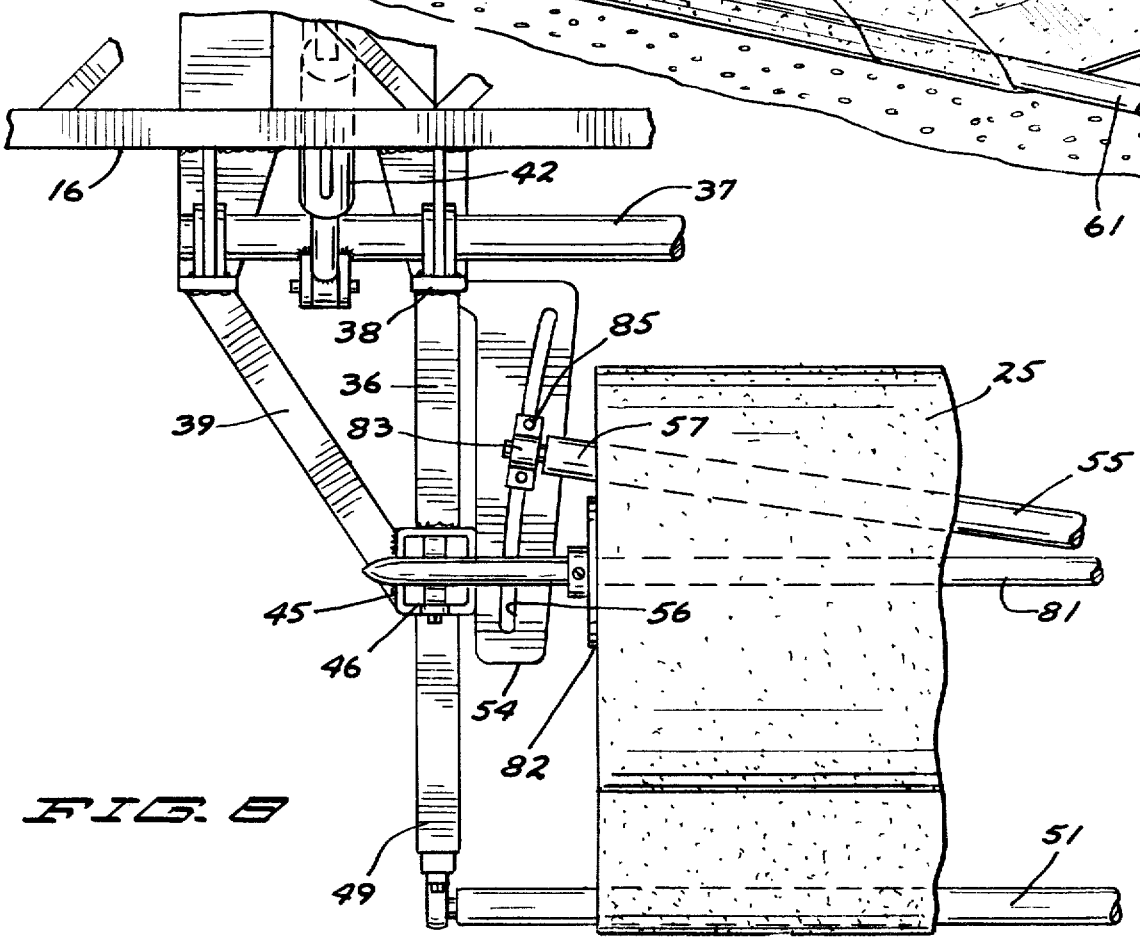
FIG. 8

UNDERTRACK FABRIC APPLICATOR

BACKGROUND OF THE INVENTION

This invention relates to railroad undertrack maintenance equipment, and, more particularly, to apparatus for laying fabric under raised portions of track.

Railroad track beds must be carefully prepared before rails and ties are positioned, so as to obtain the firmest possible foundation for the track. Ballast consisting of crushed or coarse rock is applied on top of subgrade materials, the ballast serving as the bed on which the track is placed. It has been the practice to treat the ballast with lime or other chemicals to achieve cohesiveness, so as to prevent the ballast from sinking into the subgrade. More recently, a continuous layer of fabric has been applied over the subgrade before the ballast is layed, the fabric serving as a barrier between the ballast and subgrade. The use of protective fabric in such manner has greatly improved the durability of track beds, and has significantly lowered the cost of bed preparation, compared to lime and similar treatments.

The laying of fabric under existing tracks presents obvious difficulties. At present one practice is to lift a section of track and move it to one side. Workmen then place a roll of fabric on the exposed bed, after ballast has been removed, and unroll the fabric. After clean ballast is applied, the raised track is then moved back over the bed and set on top of ballast covering the fabric. This process is repeated over and over again until the entire rail section has been covered. In another method, ballast is removed beneath track and a device is inserted to raise the track approximately 15 to 20 inches, which allows insertion of a small roll of fabric. As the device is moved forward, fabric is unrolled onto the cleared track bed. Such techniques require considerable manpower, leading to high application costs.

Presently available maintenance equipment consists of machines having boxlike frames and being capable of riding along the track while performing a variety of maintenance operations, including the plowing out of crib material, the removal of reject ties, the realigning of track, and the smoothing of the track bed. Such machines are also used to raise the track above the ground to allow workmen to apply fabric, as noted, but they have not been adaptable for laying the fabric continuously as the equipment moves down track. That is, none of the presently available undertrack maintenance machines can be used to continuously unroll and apply fabric under existing track without the use of workmen to manually position the fabric roll under the track structure. Also, the fabric roll used conventionally must be of a small diameter, usually no more than about 20 inches, such that it can fit within the limited space between the raised track and the track bed.

Conventional apparatus for applying fabric under raised track is disclosed in Scheuchzer, U.S. Pat. No. 4,004,524. A small roll of fabric is disposed under the raised track and unrolled onto the prepared track bed as the undertrack maintenance machine progresses. Such apparatus cannot use large diameter fabric rolls, which means that workmen are required for frequent replacement of fabric rolls.

SUMMARY OF THE INVENTION

In accordance with this invention there is provided an undertrack fabric applicator for use on railway undertrack maintenance machines of the type which raise track above the bed as they move along the track, the applicator comprising a pair of spaced apart arms connected to one side of the maintenance machine frame above the area of the frame where the track will be raised, the arms extending outwardly from the machine frame, a bar connected substantially perpendicular across the outer end of each arm, the bars being adapted for rotatably mounting of a roll of fabric on their upper ends and having their lower ends extending below the level of the raised track, an extension member connected substantially perpendicularly to the lower end of the bar of each arm and extending outwardly, an idler roller connected across the arms from the outer end of one extension member to the other, a tension roller connected across the arms below the level of the roll of fabric, holding means disposed on the side of the machine opposite that on which the pair of arms are connected, the holding means being positioned and adapted for securing the outer end of a tubular member extending diagonally under the machine frame, and an applicator tube running from the outer end of one extension member diagonally under the machine frame to the holding means on the other side thereof. During movement of the machine on the track, fabric is continuously unrolled from the fabric roll and passed under the tension roller, over the idler roller, over the applicator tube and onto the track bed beneath the raised track section.

Preferably, a pair of spaced apart arms are pivotally connected to opposite sides of the maintenance machine, with the arms on one side being aligned with the arms on the other side. Each arm comprises a V-shaped member pivotally secured at its closed end to the maintenance machine frame, such V-shaped members being pivotal by hydraulic piston cylinders on the machine frame from a raised travel position to an operating position with the bar perpendicular to the ground. Also, each bar is preferably disposed in a sleeve attached across the ends of the V-shaped members, with adjustment means on the sleeve to permit raising or lowering of the bars, idler roller and applicator tube to accommodate various depths of track. The applicator tube is non-rotatable, to prevent riding up of the fabric during application, whereas the idler and tension rollers rotate as the fabric is unrolled and layed out under the raised track.

The pairs of V-shaped arms are preferably aligned on the machine frame across from one another such that the applicator tube extends from the outer end of one extension member diagonally under the raised track to the outer end of the appropriate extension member on the opposite side. Also, the V-shaped members are secured to a torque tube rotatably disposed on and parallel to the side of the machine frame on each side thereof. The tension roller is supported at one end on a column extending perpendicularly from an extension tube, and the other end of the tension roller is mounted on an adjustment plate such that the tension roller can be moved toward or away from the machine frame, to thereby increase or decrease tension on the fabric during the fabric application process.

It is therefore a primary object of this invention to provide an apparatus for use on undertrack railroad maintenance machinery for accomplishing the continuous unrolling and applying of larger diameter rolls of fabric to a prepared track bed under raised track sections as the machinery moves along the track.

It is another object of this invention to provide an apparatus for greatly reducing the time and expense in preparing a track bed using protective fabric under existing track.

It is another object of this invention to provide an apparatus for the continuous application of protective fabric over the subgrade of a track bed, which apparatus eliminates the need for extra workmen to assist the machine operator.

It is a further object of this invention to provide an apparatus for the continuous application of fabric under existing track, which apparatus is inexpensively manufactured of a minimum of parts, and which can be readily adapted for use on undertrack railroad maintenance machinery.

BRIEF DESCRIPTION OF THE DRAWINGS

FIG. 7 is a schematic view showing the flow of fabric through the undertrack fabric applicator, the view being from the opposite side as shown in FIG. 2; and FIG. 8 is an enlarged fragmentary view of one end of the undertrack fabric applicator.

DESCRIPTION OF THE PREFERRED EMBODIMENTS

Figure 1:
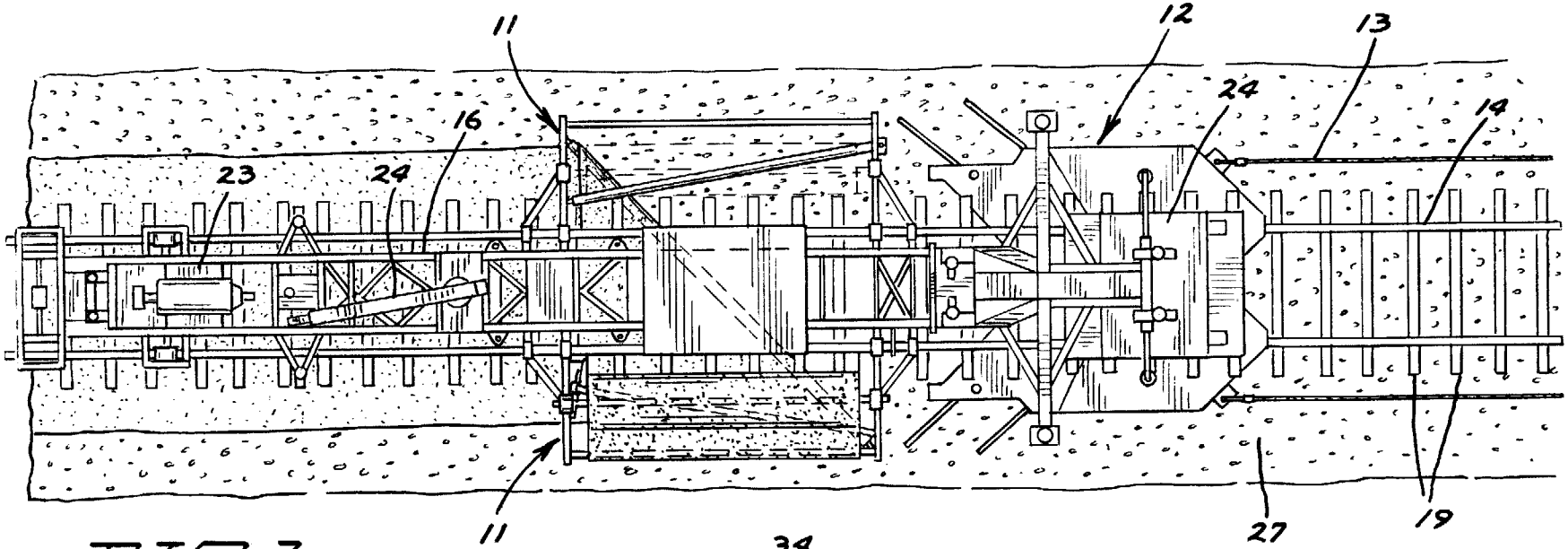
FIG. 1 is a top plan view of the undertrack fabric applicator of this invention in position on a railway undertrack maintenance machine.
Figure 2:
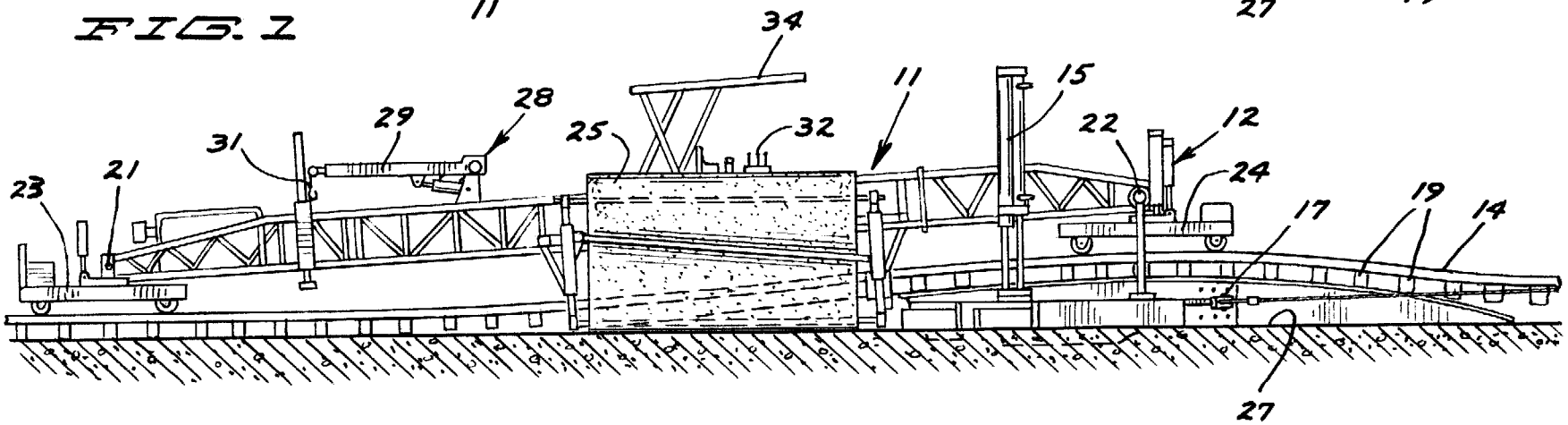
FIG. 2 is a side elevational view of the machine and fabric applicator shown in FIG. 1.

Referring to FIGS. 1 and 2 of the drawings, the undertrack fabric applicator 11 is shown in position on a railway undertrack maintenance machine 12 which is towed by means of cables 13 attached to a winch cart or locomotive (not shown) over rails 14. Machine 12 is used in performing a variety of railway maintenance operations, including raising of track, resurfacing, reballasting, and undercutting. Jack 15 is secured to frame 16 for initial raising of track 14 to enable plow 17 to be inserted under ties 19, after which the winch cart or locomotive pulls machine 12 to continuously raise the track, the machine 12 traveling to the right at a speed of about 1 mile per hour. As machine 12 moves along the track, frame 16 pivots at points 21, 22 on carriages 23, 24 which ride on rails 14.

As will be discussed in more detail below, a fabric roll 25 is mounted on undertrack fabric applicator 11 parallel to the track bed 27, which has been cleaned up of old ballast down to the subgrade, in preparation for laying of fabric under the raised track. Machine 12 is provided with crane 28 having extensible boom 29 with hook 31 for lifting and mounting of fabric roll 25 on undertrack fabric applicator 11. Operator controls 32, including hydraulic controls for moving applicator 11 from its travel position to its operating position, are disposed on frame 16 under canopy 34.

Figure 3:
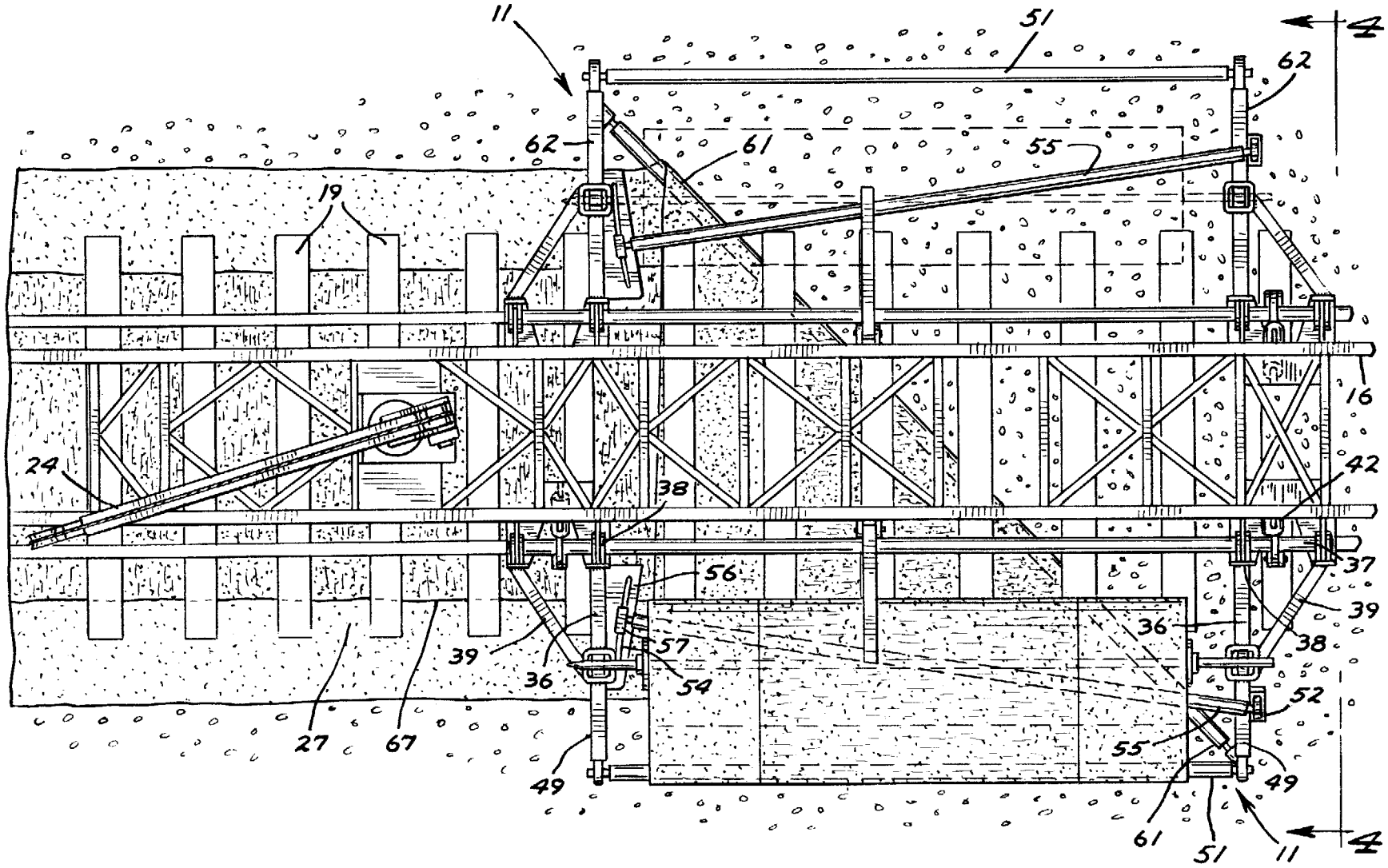
FIG. 3 is an enlarged view of the undertrack fabric applicator shown in FIG. 1.

Referring to FIG. 3, applicator 11 comprises a pair of arms 36 secured to torque tube 37 by brackets 38. Braces 39 extend from an outer end of the torque tube 37 to the outer end of arms 36. Torque tube 37 is rotatable by hydraulic piston cylinder 42 disposed on machine frame 16, such that arms 36 can be pivoted from a raised or travel position to the operable position shown in FIG. 3.

Figure 4:
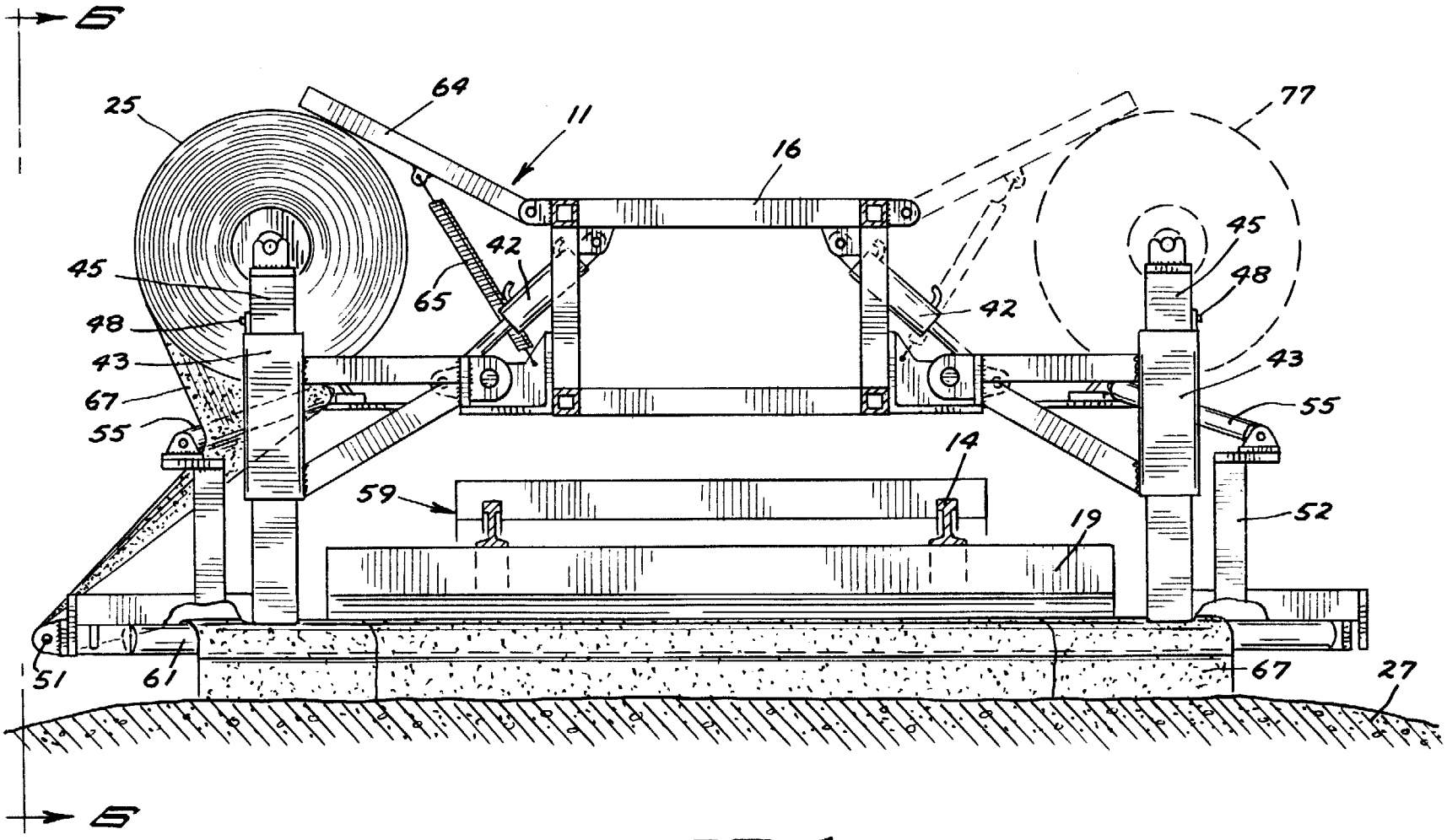
FIG. 4 is a cross sectional view taken along line 4—4 of FIG. 3.

As shown more clearly in FIG. 4, arms 36 are formed in a V-shape, with the closed end of the V affixed to torque tube 37, the outer ends of the arms being affixed to sleeves 43, which in operable position of fabricator 11 are substantially perpendicular to track bed 27. Bar 45 is slidably held within sleeve 43 at each end of fabric applicator 11 for mounting of fabric roll 25 on yoke 46 secured to the upper portion of bar 45. Gauge stops 48 are secured to bars 45 to allow bars 45 to be raised or lowered to accommodate varying depths of track, as will be described in more detail with reference to FIG. 6.

Bars 45 have extension members 49 connected at their lower ends and extending outwardly, with an idler roller 51 being rotatably mounted across the outer ends of extension members 49. Support column 52 is disposed perpendicularly to extension member 49, and parallel to bar 45, and adjustment plate 54 is connected to the opposite arm 36 for mounting of tension roller 55. Adjustment plate 54 has an arcuate slot 56 for slidably engaging end portion 57 of tension roller 55, such that tension roller 55 can be moved toward and away from machine frame 16 to increase tension on the fabric as it is unrolled from fabric roll 25 and applied under the raised portion 59 of track. Applicator tube 61 is mounted at the outer end of extension member 49 and extends diagonally under machine frame 16, including raised track portion 59, to the outer end of extension member 49, on the opposite side of machine 12. Applicator tube 61 extends at approximately a 45 degree angle with respect to the track.

Tension bars 64 are disposed on the machine frame 16 approximately mid-way between spaced apart arms 36, the tension bars 64 being provided with spring 65 for exerting downward pressure on fabric rolls 25.

Figure 6:
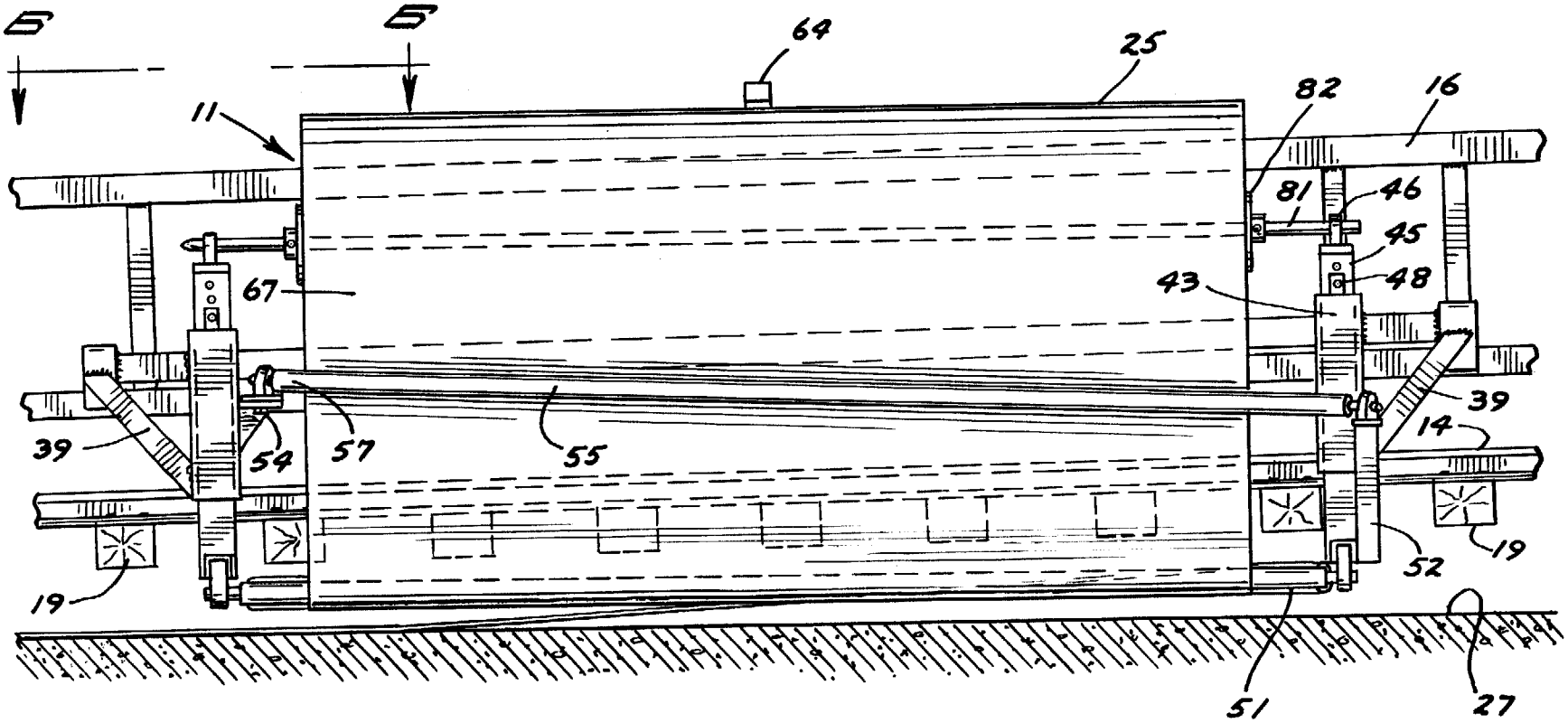
FIG. 6 is a side elevational view of the undertrack fabric applicator shown in FIG. 1.

As shown most clearly in FIGS. 4, 6, and 7, fabric 67 is continuously unrolled from fabric roll 25 and passed under tension roller 55, over idler roller 51, and over and under applicator tube 61 and onto track bed 27 under raised track section 59. Tension bar 64 and tension roller 55 maintain contact with fabric 67 and exert sufficient pressure thereon such that fabric 67 flows smoothly from fabric roll 27 around idler roller 51 and applicator tube 61 into position on track bed 27. Accordingly, fabric can be continuously applied over a track bed as the maintenance machine is being towed over a track. There is no requirement that the track be moved to one side, or that any manual means be employed for rolling out the fabric onto a track bed. The operator seated under canopy 34 at controls 32 can easily carry out the fabric laying operation as well as all the other operations performed by machine 12, without the need for extra workmen.

Figure 5:
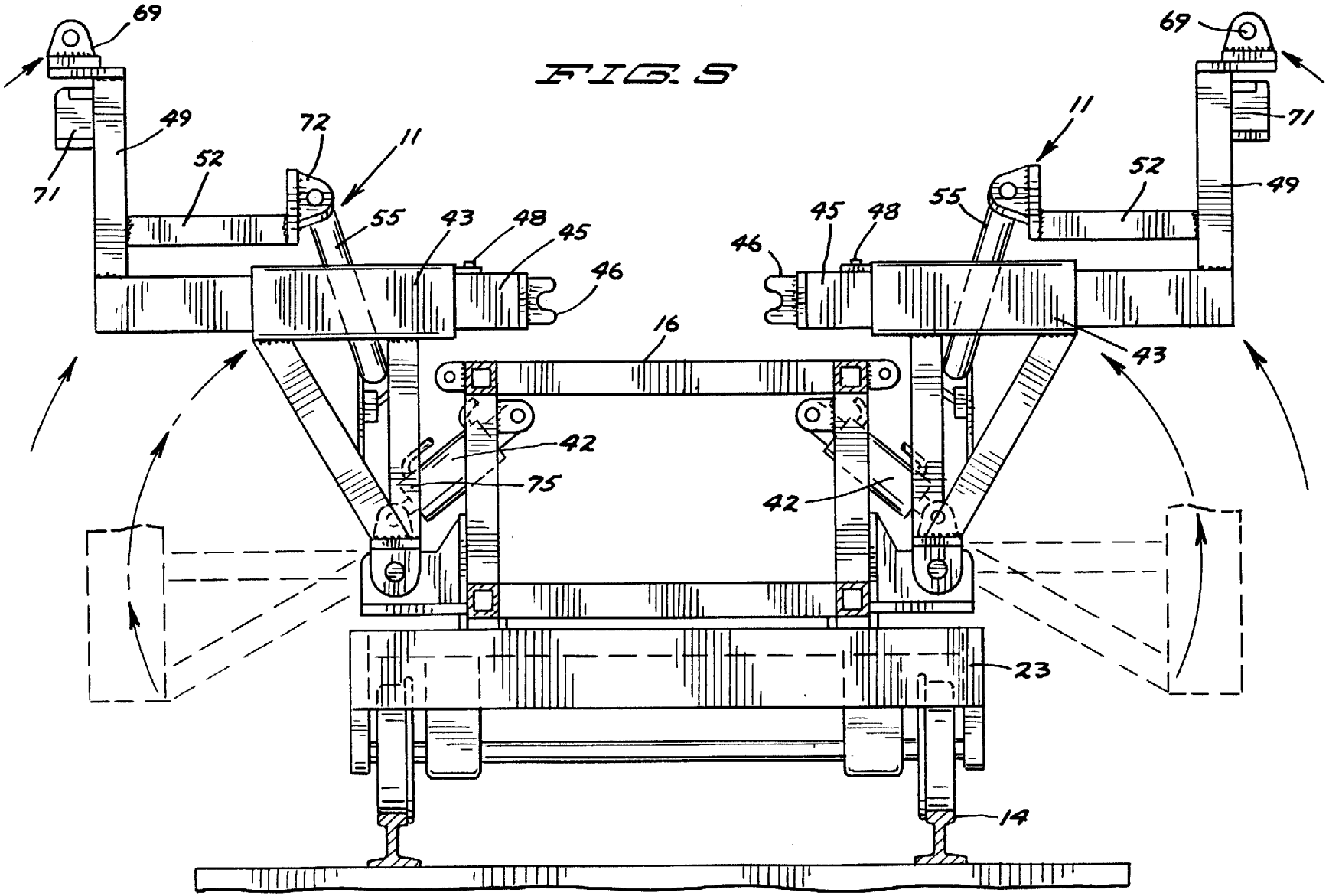
FIG. 5 is a view similar to FIG. 4, but showing the undertrack fabric applicator in raised or travel position.

Referring to FIG. 5, applicator 11 is shown in raised or travel position on machine frame 16 after idler roller 51 and applicator tube 61 have been detached from brackets 69, 71. Similarly, tension rollers 55 could also be removed from applicator 11 by detaching them from brackets 72, if desired. Raising of applicator 11 from its operable position as shown in the other figures is accomplished by means of hydraulic piston cylinder 42, which upon retraction of piston rod 75 exerts torque on torque tube 37 to thereby effect pivoting of arms 36 in the direction of the arrows from the dotted line position to the raised position shown.

It is noted that a pair of fabric applicators are disposed on machine frame 16, one applicator being in line with the other on opposite sides of machine frame 16. Applicator tube 61 can then be extended diagonally under the raised track section, running from the outer end of one extension member to the outer end of the corresponding extension member numeral 49 on the opposite side of machine 12. Alternately, a single fabric applicator 11 could be disposed on one side of machine 12, and means provided on the opposite side thereof for holding and positioning of the outer end of applicator tube 61. However, as shown in the drawings, the use of a matched pair of applicators 11 permits the storage of another fabric roll on the opposite side of the machine. Also, the tension roller, idler roller, and applicator tube can be readily switched from one side to the other as is desired. For example, a storage fabric roll 77, as indicated by dotted lines in FIG. 4 can be mounted on machine 12 at the same time fabric roll 25 is mounted, such that when fabric roll 25 is exhausted the storage fabric roll can be moved by means of the crane 24 to replace the exhausted roll, for continued fabric application from the same side of the machine. Or, the tension and idler rollers can be switched from one side of the frame to the other, with appropriate repositioning of the applicator tube, for particular railroad line clearances. That is, the apparatus allows fabric to be applied from either side of the maintenance machine, whenever such operation is required.

As shown in FIG. 6, fabric roll 25 is mounted on support tube 81 using retainer plates 82 at either end thereof, the support tube 81 being rotatably mounted on yokes 46 extending upwardly from bars 36, with applicator 11 in operable position. Adjustment plate 54 is mounted slightly above the upper level of support column 52, and closer to machine frame 16, such that tension roller 55 can be mounted with end portion 57 being above the level of its opposite end, and also closer to machine frame 16. Such positioning of tension roller 55 increases the tension on fabric 67 along the trailing edge thereof, i.e. along the edge shown on the left in FIG. 6. Also, tension roller 55 and idler roller 51 are rotatably mounted such that they can rotate as fabric is passed around them, whereas applicator tube 61 is non-rotatably mounted. Such arrangement prevents riding up of fabric 67 on applicator tube 61 during the application process. The combination of tension bar 64, tension roller 55, and non-rotating applicator tube 61 assures a smooth and continuous application of fabric onto a track bed during operation of the track raising machine.

Fabric roll 25 is maintained in a parallel relationship with respect to track bed 27 by means of gauge stops 48 connected to the upper portions of bars 45. Gauge stops 48 can be adjusted to raise or lower either end of applicator 11 so as to keep fabric roll 25 parallel to track bed 27. Also, gauge stops 48 can be used to raise or lower bars 45 to accommodate various depths of track. That is, where rails 14 and ties 19 are greater in depth, bars 45 can be lowered to properly position idler roller 51 and applicator tube 61 between the raised track section and the track bed 27.

Referring to FIG. 8, adjustment plate 54 is secured to arm 36 and bar 45, and has arcuate slot 56, for slidably engaging projection 83 at end 57 of tension roller 55. Projection 83 has bolts 85 which can be tightened to secure end 57 of tension roller 55 at any position within arcuate slot 56. Where more tension is required on fabric 67 during the application process, bolts 85 can be loosened and end 57 slid along arcuate slot 56 toward frame 16, with the bolts then being tightened to secure tension roller 55 in position. After all of the fabric has been unrolled and applied to a track bed, the outer ends of support tube 81 can be detached from yokes 46 on bars 45, and tension roller 55, idler roller 51, and applicator tube 61 can be detached from applicator 11. Hydraulic piston cylinder 42 can then be activated to exert torque on torque tube 37, to thereby raise arm 36 on either side of applicator 11, to bring applicator 11 to the travel position as shown in FIG. 5.

In operation, fabric applicator 11 is pivoted out from machine frame 16 from its raised position as shown in FIG. 5 by means of hydraulic piston cylinder 42 to the operating position as described above. A fabric roll is then lifted by the crane mounted on the maintenance machine and mounted on the yokes affixed to the upper ends of the bars attached to each arm. The tension roller, idler roller, and applicator tube are then connected to the applicator, and fabric is passed by hand under the tension roller, over the idler roller, and over and around the applicator tube beneath the portion of the track which has been raised by the maintenance machine. The free end of the fabric is then brought into contact with the track bed and secured until the maintenance machine moves down the track and the fabric can be held in permanent position by the ballast and track secured on top thereof. Once the free end of the fabric has been secured, there is no additional need for extra workmen to manually feed or control the application of fabric onto the track bed beneath the raised track sections. Fabric will be continuously passed through applicator 11 and onto the track bed as the maintenance machine travels along at a speed of about one mile per hour. Also, larger diameter rolls of fabric can be used with the applicator, eliminating frequent roll changes; the rolls can be twice as large in diameter as those disposed under the raised track. The fabric applicator of this invention thereby greatly reduces the time and expense in preparing a track bed using fabric under existing track.

It is claimed:

1. An undertrack fabric applicator for use on a railway undertrack maintenance machine of the type which raises track above the track bed as it moves along the track, comprising:

a pair of spaced apart arms connected to one side of the maintenance machine frame immediately behind the track raising portion thereof, the arms extending outwardly from the machine frame, a bar connected across the outer end of each arm in a substantially vertical position with respect to the track bed, the bars being adapted for rotatably mounting of a roll of fabric between the arms, with the lower ends of the bars extending below the level of the raised track, an extension member connected to the lower end of the bar of each arm and extending outwardly in a substantially horizontal position with respect to the track bed, an idler roller connected across the arms from the outer end of one extension member to the other;

a tension roller connected across the arms below the level of the fabric roll, holding means disposed on the side of the maintenance machine opposite that on which the pair of arms are connected, the holding means being positioned and adapted for securing the outer end of an applicator tube extending diagonally under the raised track from one side of the machine frame to the other, and a non-rotatable applicator tube running from the outer end of one extension member diagonally under the raised section of track to the holding means on the other side thereof, such that during movement of the maintenance machine on the track the fabric can be continuously unrolled from the fabric roll and passed under the tension roller, over the idler roller, over the applicator tube, under the raised track, and onto the prepared track bed.

2. The undertrack fabric applicator of claim 1 additionally comprising a second pair of spaced apart arms disposed on the opposite side of the maintenance machine frame from that of the first, and wherein each of the arms comprises a V-shaped member pivotally secured at its closed end to the maintenance machine frame, with the V-shaped members on each side being pivotable by hydraulic piston cylinders disposed on opposite sides of the machine frame from an operable position to a raised travel position.

3. The undertrack fabric applicator of claim 2 additionally comprising a sleeve attached across the ends of the V-shaped members, the sleeves being adapted for slidably receiving the bars, to allow movement of the bars, idler roller and applicator tube either toward or away from the track bed when the applicator is in operating position.

4. The undertrack fabric applicator of claim 3 additionally comprising gauge stops disposed on the bar of each arm and engaging the sleeve thereof, such that by adjustment of the gauge stops the idler roller and applicator tube can be raised or lowered to set distances, when the applicator is in operating position.

5. The undertrack fabric applicator of claim 2 additionally comprising a support column extending perpendicularly from one of the extension members of each pair of arms, for supporting one end of the tension roller of each pair of arms, and additionally comprising an adjustment plate disposed on the arm not bearing the support column, for receiving the opposite end of the tension roller, the adjustment plate being adapted for manual movement to bring the tension roller toward or away from the roll of fabric so as to increase or decrease tension on the fabric as it is unrolled and applied onto the track bed.

6. The undertrack fabric applicator of claim 5 wherein the end of the tension roller secured to the adjustment plate is substantially closer to the maintenance machine frame than the end of the tension roller mounted on the extension support column, and wherein the adjustment plate is disposed above the upper end of the support column.

7. The undertrack fabric applicator of claim 2 additionally comprising a tension bar extending outwardly from the maintenance machine frame approximately at the mid point between the spaced apart arms and above the upper portion of the bars, the tension bar being adapted for contacting and exerting downward pressure on a roll of fabric mounted across the bars, and spring means running from the underside of the inner portion of the tension bar to the machine frame, for drawing the tension bar onto the roll of fabric.

8. The undertrack fabric applicator of claim 2 wherein the applicator tube is disposed diagonally under the maintenance machine frame at approximately a 45 degree angle therewith.

9. The undertrack fabric applicator of claim 2 wherein the tension roller, idler roller, and applicator tube comprise a set which can be changed from operating position on one side of the maintenance machine frame to the other.

10. An undertrack fabric applicator for use on a railway undertrack maintenance machine of the type which raises track above the track bed as the machine moves along the track, comprising:

a pair of torque tubes mounted across from one another on either side of the maintenance machine frame, the torque tubes being disposed parallelly to the ground, V-shaped arms secured at their closed ends to the end portions of the torque tubes, hydraulic means mounted on the maintenance machine frame for applying torque to the torque tubes to effect pivoting of the V-shaped arms from a vertical travel position to an outwardly extending operable position, a sleeve member connected substantially perpendicular across the outer ends of the V-shaped arms, such that the sleeves will be in substantially vertical position when the arms have been pivoted to an operable position, a bar slidably secured in the sleeves of each arm, the bars being adapted for rotatably mounting of a roll of fabric between the V-shaped arms with the lower ends of the bars extending below the level of the raised track, an extension member connected to the lower end of the bar of each V-shaped arm and extending outwardly therefrom in a substantially horizontal position with respect to the track bed, a support column mounted near the inner end of the extension member parallel to the bar and being substantially shorter than the bar, an adjustment plate mounted on the extension member opposite that bearing the support column, a tension roller mounted across the V-shaped arms from the support column of one extension member to the adjustment plate of the other, an idler roller running from the outer end of one extension member to the outer end of the other extension member, a non-rotatable applicator tube running from the outer end of one extension member diagonally under the railway maintenance machine frame to the outer end of the extension member on the other side thereof, such that during movement of the maintenance machine on the track fabric can be continuously unrolled from a fabric roll and passed under the tension roller, over the idler roller, over the applicator tube, and onto the track bed under the track section temporarily raised above the track bed by the maintenance machine.

11. The undertrack fabric applicator of claim 10 wherein the tension roller, idler roller, and applicator tube can be detached from the pair of arms on one side of the maintenance frame and secured across the arms of the other side, with the applicator tube running diagonally under the machine frame in a position complimentary to that of the opposite side.

12. The undertrack fabric applicator of claim 10 wherein the adjustment plate has an arcuate slot running outwardly from the machine frame, and wherein the end of the tension roller mounted on the adjustment plate slidably engages the arcuate slot, such that the end of the tension roller connected to the adjustment plate can be moved toward or away from the roll of fabric mounted across the V-shaped arms to guide the unrolling of the fabric by means of applying tension to the fabric as it moves over the applicator roll, thus keeping the fabric in line with the track.

13. The undertrack fabric applicator of claim 10 additionally comprising gauge stops mounted on the upper portion of each bar above the level of the sleeve, and adapted for engaging the sleeve to allow the bar to be raised or lowered within the sleeve, to accommodate varying depths of track.

14. The undertrack fabric applicator of claim 10 additionally comprising a tension bar disposed on the frame and extending outwardly above the roll of fabric, and a spring secured between the tension bar and the machine frame for urging the tension bar against the roll of fabric during the fabric application process.

15. The undertrack fabric applicator of claim 10 wherein the arms are adapted for carrying fabric rolls of greater diameter than can be placed under the raised track section, thereby allowing for higher application rates in a single operation.

* * * * *